US008575504B2

(12) United States Patent
Eisner

(10) Patent No.: US 8,575,504 B2
(45) Date of Patent: Nov. 5, 2013

(54) SWITCH, IN PARTICULAR SWITCH DISCONNECTOR FOR LOW VOLTAGES

(75) Inventor: Matthias Eisner, Neukirchen (DE)

(73) Assignee: Siemens Aktiengesellschaft, Munich (DE)

( * ) Notice: Subject to any disclaimer, the term of this patent is extended or adjusted under 35 U.S.C. 154(b) by 254 days.

(21) Appl. No.: 13/163,845

(22) Filed: Jun. 20, 2011

(65) Prior Publication Data

US 2011/0308928 A1 Dec. 22, 2011

(30) Foreign Application Priority Data

Jun. 22, 2010 (DE) ..... 10 2010 025 041

(51) Int. Cl.
*H01H 9/02* (2006.01)

(52) U.S. Cl.
USPC ..... 200/306; 218/157; 335/201

(58) Field of Classification Search
USPC ..... 200/306; 218/22–26, 34, 155–158; 335/201
See application file for complete search history.

(56) References Cited

U.S. PATENT DOCUMENTS

| | | | | |
|---|---|---|---|---|
| 4,650,940 | A * | 3/1987 | Grunert et al. | 218/155 |
| 5,753,878 | A * | 5/1998 | Doughty et al. | 218/157 |
| 6,426,688 | B1 * | 7/2002 | DeVizzi et al. | 335/16 |
| 7,259,646 | B2 * | 8/2007 | Rab et al. | 335/201 |
| 7,586,057 | B2 * | 9/2009 | Sisson et al. | 218/157 |
| 8,247,727 | B2 * | 8/2012 | Zhou et al. | 218/157 |
| 2005/0068131 | A1 | 3/2005 | Azzola et al. | |
| 2006/0104003 | A1 | 5/2006 | Gautier | |

FOREIGN PATENT DOCUMENTS

| | | |
|---|---|---|
| CN | 201408682 | 2/2010 |
| DE | 79 24 748 U1 | 11/1980 |
| DE | 37 05 216 A1 | 9/1988 |
| DE | 10 2005 007 301 A1 | 8/2006 |
| DE | 10 2006 030 952 A1 | 1/2008 |
| JP | 2001-015003 | 1/2001 |

OTHER PUBLICATIONS

Search Report for corresponding Chinese patent application No. 201010219954.3 dated Jul. 11, 2013 (with English translation).

* cited by examiner

*Primary Examiner* — Xuong Chung Trans
(74) *Attorney, Agent, or Firm* — Harness, Dickey & Pierce, P.L.C.

(57) ABSTRACT

A switch is disclosed, in particular a switch disconnector for low voltages, including at least one cuboid pole housing; a switching shaft which runs transversely with respect to the side walls and disconnects contact elements which are resting on one another in order to open the switch; and an aperture opening formed in one wall of the pole housing. In order to prevent the risk of an electrical flashover to the rear wall, it is proposed in at least one embodiment, that the aperture opening is formed in a side wall, to which a channel is connected, which dissipates any overpressure that occurs in the pole housing in an end-face outlet direction.

9 Claims, 2 Drawing Sheets

SWITCH, IN PARTICULAR SWITCH DISCONNECTOR FOR LOW VOLTAGES

PRIORITY STATEMENT

The present application hereby claims priority under 35 U.S.C. §119 on German patent application number DE 10 2010 025 041.4 filed Jun. 22, 2010, the entire contents of which are hereby incorporated herein by reference.

FIELD

At least one embodiment of the invention generally relates to a switch.

BACKGROUND

DE 10 2005 007 301 A1 discloses a switch in which a moving contact piece is arranged in a cuboid housing and rests on a stationary contact piece when the switch is closed. The current flows via the two contact pieces, which are disconnected by means of a switching toggle in order to open the switch. The arc which is struck in the process is quenched with the aid of quenching plates which are arranged in the area of the contact pieces. The arc produces a high gas overpressure, which is dissipated externally through a vent opening in the housing side wall. In order to prevent these gases from re-entering, the vent opening is provided with a curvature or direction change.

In other known switch disconnectors, the contact pieces are arranged at the free ends of a contact lever which can pivot and is often referred to as a double lever. In the case of a multipole switch, one contact lever is in each case provided for each phase. All of the contact levers are pivoted jointly by way of one switching shaft in order to interrupt the current, with their contact pieces being disconnected from one another.

This has the disadvantage that the vent opening must be arranged directly behind the quenching plates if they are intended to support the magnetic attraction force of the plates by means of the gas flow. It is therefore located close to the rear face of the switch, thus resulting in a risk of electrical flashover to the rear wall.

SUMMARY

In at least one embodiment of the invention, risk of an electrical flashover to the rear wall is reduced or even prevented.

At least one embodiment is directed to a switch including a plurality of pole housings; the dependent claims relate to advantageous refinements.

At least one embodiment provides that the aperture opening is formed in a side wall and a channel is connected to the aperture opening, which dissipates any overpressure that occurs in the pole housing in an end-face outlet direction. The basic idea of the invention is to use a channel to dissipate the hot gases, which expand as a result of the arc being struck and are at a very high pressure, in particular from the rear wall of the switch or of the switching cabinet in which the switch is installed.

Unimpeded passage of the gas flow is achieved by the aperture opening running transversely with respect to the side wall.

This is reinforced by the center line of the aperture opening being essentially a straight line.

In the case of a switch including a plurality of pole housings which are arranged alongside one another, the invention proposes that the aperture opening in each case be formed in the side wall on one side of the pole housing, and that a channel be connected to the aperture opening, which dissipates any overpressure which occurs in the pole housing in an end-face outlet direction.

It is technically simple for intermediate walls to be arranged between the side walls, and for the channel in each case to run or be formed in an intermediate wall.

The isolating effect can be improved if the intermediate walls each have a web which projects outward.

The use of channels makes it possible to position the outlet direction away from the operator, when the switching shaft can be operated by an operator.

BRIEF DESCRIPTION OF THE DRAWINGS

The invention will be explained in more detail in the following text with reference to one example embodiment. In the figures.

DETAILED DESCRIPTION OF THE EXAMPLE EMBODIMENTS

Figure 1:
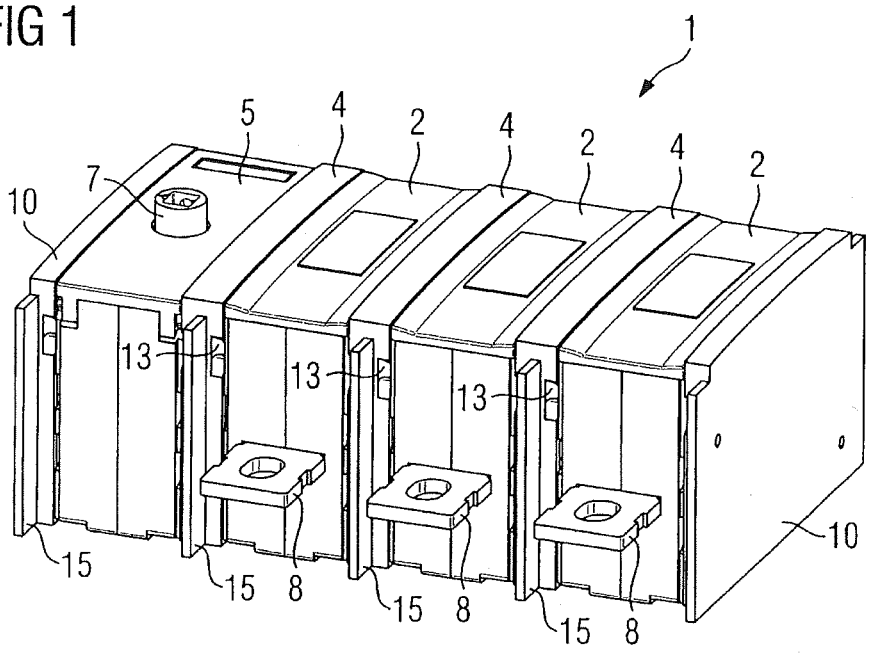
FIG. 1 shows a switch with a plurality of pole housings.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

FIG. 1 shows a multipole switch 1 having essentially cuboid pole housings 2 for each phase. The side walls 3 (see FIG. 2) of the pole housings 2 are arranged laterally alongside one another; an intermediate wall 4 is located between each of the side walls 3. Referring to FIG. 1, a control unit 5 is connected to the three pole housings 2 on the left-hand side, via which control unit 5 a common switching shaft can be rotated about its longitudinal axis by means of a handle (not shown). The switching shaft is formed from switching shaft segments 6 (see FIG. 2) and runs transversely through the side walls 3 of the pole housings 2. In order to rotate the switching shaft, a handle is inserted into an appropriate recess in a drive shaft 7 which interacts with the switching shaft 6. In principle, the switching shaft may also be any other desired switching element which disconnects the contact elements (contact pieces) in order to open the switch 1.

(First) fixed contacts 8 are used for connecting the switch 1 and project on the end faces out of the pole housings 2. One of the (second) fixed contacts 9, which are in each case located at the rear, can also be seen on the right-hand side in FIG. 2. As FIG. 1 shows, the switch 1 is closed off on the right- and left-hand side by outer walls 10.

Figure 2:
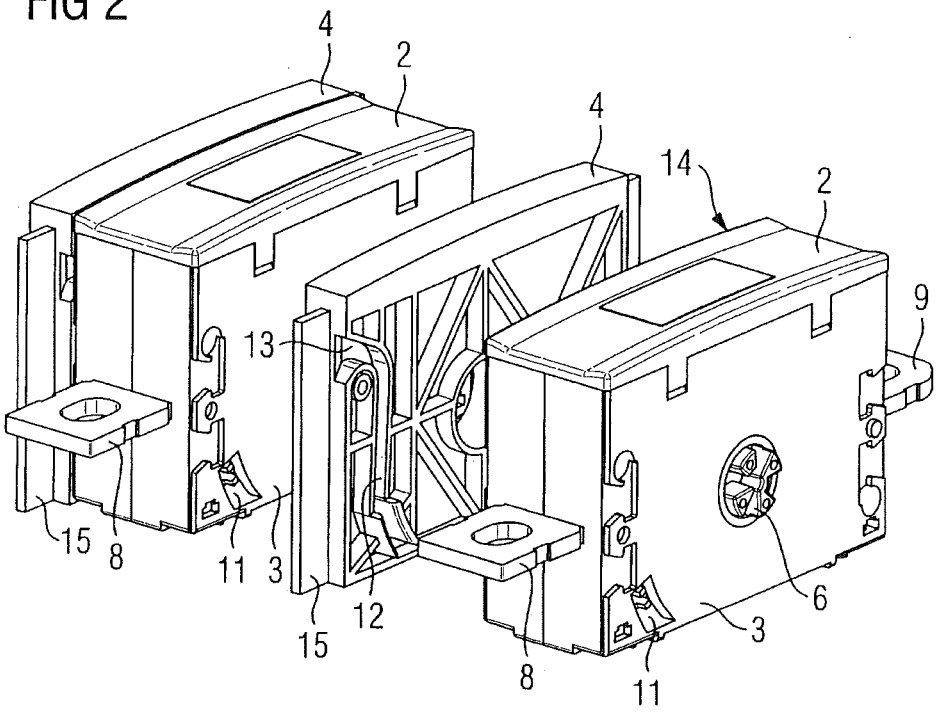
FIG. 2 shows an exploded illustration of two pole housings having an intermediate wall located between them, as shown in FIG. 1.

FIG. 2 shows an exploded illustration of two pole cassettes 4 with the intermediate wall 4. As can be seen, the pole housings 2 each have an aperture opening 11 in the right-hand side wall 3 as shown in FIG. 2. Each aperture opening 11 is connected directly to the inlet opening of a channel 12, which carries the gas upward in FIG. 2. In this case, the channel 12 is inserted into the aperture opening 11. At its upper end, there is an outlet opening 13, which is arranged on the end face and carries the gases away to the exterior in the outlet direction 16, essentially at right angles to the end face of the switch 1, and therefore away from the drive shaft 7 (the handle).

As is shown in FIG. 2, the channel 12 is formed in the intermediate wall 4. In FIG. 2, the channel 12 is open on the right-hand side and is closed at the side in each case by the left-hand wall 14 of the right-hand pole housing 2 when assembled. This also applies to the other side, of course, that is to say when the channel 12 is located on the left-hand side and is open on this side, then it is closed at the side in each case by the right-hand wall of the left-hand pole housing 2 when assembled. This also applies to the pole housing 2 which is located entirely on the outside, and in this case the channel 12 is located in an end plate 10; it can be arranged both on the right-hand side as in the figure and on the left-hand side.

Figure 3:
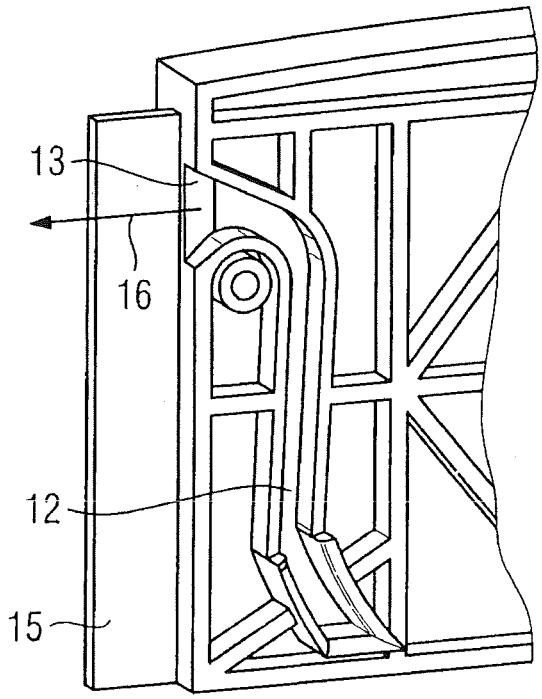
FIG. 3 shows a front view of one side of the intermediate wall as shown in FIG. 1, with a channel.

FIG. 3 shows a front view of the front part of the intermediate wall 4. As can be seen in FIG. 3, and in FIGS. 1 and 2, each intermediate wall 4 has a web 15 on the end face alongside the outlet opening 13, which web 15 prevents the emerging gases from being able to make a short circuit between the fixed contacts 8 and 9.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A switch comprising:

a cuboid pole housing, including an aperture opening formed in a side wall of the pole housing, to which a channel is connected, to dissipate overpressure occurring in the pole housing in an outlet direction;

two contact elements including a moving contact element and a stationary contact element, the moving contact element resting on the stationary contact element when the switch is closed, current flowing through the switch via a first end-face fixed contact, the two contact elements and a second fixed contact which is located on the opposite end face;

a switching shaft which disconnects the two contact elements which are resting on one another in order to open the switch; and quenching elements, arranged in the area of the two contact elements, wherein an intermediate wall is arranged adjacent the side wall, and wherein the channel runs or is formed in the intermediate wall.

2. The switch as claimed in claim 1, wherein the aperture opening runs transversely with respect to the side wall.

3. The switch as claimed in claim 1, wherein a center line of the aperture opening is essentially a straight line.

4. The switch as claimed in claim 1, wherein the switching shaft is operateable by an operator, and wherein the outlet direction faces away from the drive shaft and away from the operator.

5. A switch, comprising:

a plurality of cuboid pole housings, side walls of the plurality of cuboid pole housings being arranged laterally alongside one another;

a plurality of contact levers, one arranged in a side wall of each of the plurality of cuboid pole housings, to pivot about a rotation axis, a longitudinal axis of the plurality of each of the cuboid pole housings running transversely with respect to the rotation axis, at a free end of each of the plurality of contact levers, a moving contact element is arranged which rests on a stationary contact element when the switch is closed, with current flowing through the switch via a first fixed contact, the two contact elements including the moving and stationary contact element, the contact lever and a second fixed contact;

a common switching shaft, running parallel to the rotation axis of the plurality of contact levers and transversely through the side walls of the plurality of pole housings, to disconnect the two contact elements, which are resting on one another, in order to open the switch, the common switching shaft pivoting the plurality of contact levers;

quenching plates, arranged in an area of the contacts, for quenching any arc which occurs, an aperture opening being formed in the side wall of at least one of the plurality of cuboid pole housings, a channel being connected to the aperture opening, the aperture opening being useable to dissipate any overpressure which occurs in the at least one of the plurality of cuboid pole housings in an end-face outlet direction, wherein intermediate walls are arranged between the side walls, and wherein the channel runs or is formed in one of the intermediate walls.

6. The switch as claimed in claim 5, wherein the intermediate walls each include a web witch projects outward.

7. The switch as claimed in claim 5, wherein the switching shaft is operateable by an operator, and wherein the outlet direction faces away from the drive shaft and away from the operator.

8. The switch as claimed in claim 5, wherein, for each of the plurality of cuboid pole housings, intermediate walls are arranged between the side walls, and the channel runs or is formed in one of the intermediate walls.

9. The switch as claimed in claim 8, wherein the intermediate walls each include a web which projects outward.

* * * * *